United States Patent [19]

Nicoud

[11] 4,127,426

[45] Nov. 28, 1978

[54] METHOD OF MAKING ELECTRICAL CONDUCTORS OF ALUMINUM-IRON ALLOYS

[75] Inventor: Jean-Claude Nicoud, Saint-Egreve, France

[73] Assignee: Societe de Vente de L'Aluminium Pechiney, Paris, France

[21] Appl. No.: 685,678

[22] Filed: May 12, 1976

[30] Foreign Application Priority Data

May 14, 1975 [FR] France ..... 75 15728

[51] Int. Cl.[2] ..... C22F 1/04

[52] U.S. Cl. ..... 148/11.5 A; 75/0.5 C; 75/148; 148/11.5 P; 148/32; 264/111

[58] Field of Search ..... 75/138, 148, 142, 0.5 C, 75/139, 143, 147; 148/2, 3, 11.5 A, 32, 32.5, 11.5 P; 264/111

[56] References Cited

U.S. PATENT DOCUMENTS 3,359,141 12/1967 Mercier ..... 75/139

*Primary Examiner*—R. Dean

*Attorney, Agent, or Firm*—Dennison, Dennison, Meserole & Pollack

[57] ABSTRACT

The invention concerns electrical conductors of Al-Fe alloys containing from 0.5 to 5% of Fe. Conductors having a highly fibered structure which are stable up to 350° C and have a range of mechanical and electrical characteristics which are remarkable and an excellent surface state are obtained by press drawing of granules of Al-Fe alloys obtained by centrifugal spraying of the liquid metal. Application to electrical conductors in the form of wires, cables and various shaped sections such as flat sections and strips which may be flexible or rigid.

6 Claims, No Drawings

METHOD OF MAKING ELECTRICAL CONDUCTORS OF ALUMINUM-IRON ALLOYS

The present invention concerns electrical conductors of aluminum-iron alloys generally and more particularly, electrical conductors of Al-Fe alloys containing from 0.5 to 5% of Fe having a very highly fibered structure in the longitudinal direction and possessing a whole range of mechanical and electrical properties which enables them to be employed in either bare or insulated form, either flexible or rigid, strips or flat sections, and hollow or solid shaped sections, such as tubes for connecting collars and sleeves, and bare or insulated wires and cables. The invention also concerns a process for making these conductors by drawing metal granules.

Because of its natural abundance, its relatively low price, and its conductivity, which is approximately $\frac{2}{3}$ that of pure copper, aluminum is widely used as an electrical conductor. Unfortunately, its mechanical properties in the pure state are insufficient in many cases and the majority of the alloying elements which notably improve its mechanical properties lower its electrical conductivity by amounts which are often unacceptable. For more than fifty years all the efforts of the investigators have been concerned with achieving a compromise between conductivity and mechanical characteristics.

Among all the possible alloying elements, iron enables a fairly good compromise to be achieved. Al-Fe alloys for electrical conductors have been described for example in French Patent No. 2,009,027 to Southwire and U.K. Pat. No. 1,286,720 to Kaiser with contents of iron ranging from a few tenths of a percent to about 3%. These alloys have been obtained by conventional fusion, casting, rolling and wire drawing methods. It is known furthermore that the solubility at ambient temperature of iron in aluminum in the solid state is low (0.052% according to Kent Van Horn, Aluminium, Vol. I, page 174, Table 4), and increases rapidly with temperature in liquid aluminum:

| Temp. ° C | 660 | 700 | 750 | 800 | 850 | 900 | 950 | 1000 |
|---|---|---|---|---|---|---|---|---|
| Solubility in % by weight | 2.0 | 3.0 | 4.5 | 6.2 | 8.5 | 11 | 14 | 18 |

In addition, there exist intermetallic compounds, in particular $Al_3Fe$ and $Al_6Fe$, which form during the solidification. In the Al-Fe alloys prepared in the conventional manner, most of the iron is present in the form of these intermetallic compounds. The result is that the electrical conductors of Al-Fe alloys manufactured hitherto according to the conventional processes do not exhibit characteristics which are very much better than those of pure, unalloyed aluminum, even at the cost of complex thermomechanical treatments.

Furthermore, attempts have been made to prepare Al-Fe alloys with a high iron content by using powder metallurgy methods, starting with products obtained by the so-called "splat cooling" process consisting of cooling droplets of liquid Al-Fe alloy at extremely high rates of the order of $10^6$ and $10^7$° C. per second. French Patent Nos. 1,599,990 and 2,110,860 T. I. Group Services claim alloys containing up to 30% of iron and having a hardness "four times that of similar products cast in a chill mold." However, despite their high mechanical properties, such products are quite unsuitable for use as electrical conductors and, furthermore, the so-called "splat cooling" process does not lend itself readily to industrial scale production on account of its complexity.

The applicant has found, this being the first object of the invention, that it is possible to use as electrical conductors aluminum-iron alloys containing from 0.5 to 5% of iron, 0.02 to 0.2% of silicon, and the other usual impurities in aluminum used for electrical applications, characterized by a very high fibered structure in the longitudinal direction of the non-recrystallized, recovered type which does not change on prolonged annealing at temperatures up to the order of 350° C.; some of the iron being in a state of supersaturation in the solid state, the remainder being in the form of finely precipitated $Al_3$ Fe compound; a remarkable ability for cold bending into shapes of high curvature; a surface appearance of at least as good as that of products obtained by conventional processes; an ultimate tensile strength equal to at least 13 hb for an iron content greater than 0.5%, and equal to at least 16 hb for an iron content greater than 2%, an elongation equal to at least 30% before any thermo-mechanical treatment;

a resistivity less than 2.90 $\mu\ \Omega$ cm for Fe $<$ 1%
a resistivity less than 3.00 $\mu\ \Omega$ cm for Fe $<$ 2.5%
a resistivity less than 3.15 $\mu\ \Omega$ cm for Fe $<$ 5%

Other supplementary additions of one or more of the following elements may also be made within the limits below, for relatively soluble elements such as:

Cu $\leqq$ 0.2%
Mg $\leqq$ 0.2% or almost insoluble elements such as:

Be $\leqq$ 0.1%
B $\leqq$ 0.1%
Zr $\leqq$ 0.1%
Ni $\leqq$ 0.2%
Co $\leqq$ 0.2%
Sb $\leqq$ 0.2%

These additions may sometimes lead to resistivities slightly greater than those mentioned above without disturbing the other characteristics mentioned.

The applicant has also found, and this is a second object of the invention, that such conductors having a remarkable combination of mechanical, thermal and electrical characteristics may be obtained by an extrusion process carried out on Al-Fe alloy granules having a low oxygen content, obtained by various techniques known per se, for example, those which are described in French Patent No. 1,291,039 to Reynolds or in U.K. Patent No. 575,210 to Dudley Seaton King.

The metal or alloy heated above its melting point flows into a cylindrical crucible whose walls are perforated by holes having a diameter of the order of a millimeter and which is rotating at a high velocity around its vertical axis. The centrifugal force forces the metal through the holes in the form of more or less elongated liquid droplets which solidify during their flight through the air and are collected at some distance from the crucible. Depending on various factors, namely the nature of the metal or alloy, temperature, velocity of rotation, shape and size of the holes, granules of various shapes are obtained, ranging from almost spherical droplets to thin and elongated needles, as the case may be. These granules have a low oxygen content which ensures a good extrusion ability and a good appearance of the extruded products.

The applicant has recognized, and this is also an object of the invention, that such granules of Al-Fe alloys containing from 0.5 to 5% of Fe, from 0.03 to 0.2% of Si and the other normal impurities of aluminum for electrical applications are particularly suitable for obtaining, by extrusion, electrical conductors in the most widely differing forms, such as machine wire intended for wiredrawing, flexible or rigid strips and flat sections, and various shaped sections, hollow or solid, tubes for collars and sleeves which can be used directly when they leave the press and without any intermediate thermal or mechanical treatment for example in the case of rigid flat sections for switchboards, or can be used as semi-finished products which are subsequently transformed cold (rolling, wiredrawing or other similar processes), optionally with a final thermal softening treatment, into flexible strips of fine wire for cable and wiring work, domestic installations, etc.

The process for obtaining electrical conductors of Al-Fe alloys by drawing granules is characterized essentially by the introduction into the container of an extrusion press of the Al-Fe alloy in divided form, which has not been subjected to any special treatment after the granulation operation; the shaping, preferably into an acicular shape, of the particles of Al-Fe alloy; the sizes of the said particles, whose diameter may range from 50 to 1000 μm, and length from 1 to 10 mm; the preheating of the container of the press at a temperature between 300° and 600° C. and preferably between 350° and 550° C. — preheating of the granules is not necessary; the extrusion ratio (ratio of the cross-section of the container and of the cross section of the shaped section coming from the press) is at least equal to 5 and is preferably greater than 10; the possibility of carrying out extrusion without precompressing the batch of granulated metal; the possibility of extruding at a high rate, which can be up to at least 20 meters per minute at the die outlet; the possibility of using flat extrusion dies and dies having reduced bearing; the possibility, finally, of carrying out continuous extrusion in particular according to the technique of continuous extrusion from a die with an entrance cavity and with butt discard, in the case of extruding wire or extruding winding and spooling flat parts, for example; the possibility of extruding with multiple opening dies; the possibility, at the press outlet, of strongly cooling the shaped sections, which enables about 1 hbar to be gained in the ultimate tensile strength; the possibility, as a variant, of compressing the granules, preferably cold and optionally under a more or less strong vacuum, so as to make them into a billet which will be added to the press after preheating at a temperature below 350° C.

The examples which follow will explain the operation of the invention in more detail.

EXAMPLE 1

An Al-Fe alloy containing 2.9% of iron is prepared from so-called A5/L quality aluminum (Fe: 0.18%, Si:0.05% treated with boron in order to remove most of the elements which have an adverse effect on the electrical resistivity, such as Ti, V, Cr, etc.) and Al-Fe mother alloy containing 9.50% Fe and 0.01% Si.

The alloy, heated to 860° C., was poured into a crucible having an external diameter of 140 mm and a wall thickness of 10 mm, pierced with 250 holes of 4 mm diameter distributed at five levels, and heated with gas to as to maintain its temperature at approximately 600° C. The rotational velocity was set at 2860 rpm corresponding to a circumferential velocity of about 21 m/second.

The jet of liquid metal was protected by a current of gaseous nitrogen between the fusion furnace and the centrifugal spray crucible.

Analysis of the granules gave the following results:

Fe:2.90%
Si:0.05%
Cu:<0.005%
Mn:<0.005%
Ti:<0.002%
Cr:<0.001%
Mg:<0.001%
O:160 ppm The particles had an approximately acicular shape with a diameter between 100 and 400 micrometers and a length of 1 to 6 mm, an average unit weight of $4.10^{-4}$g, and a specific surface of the order of 50 $cm^2/g$. The density before settling is about 1.27, and alters to 1.47 after settling (without compression).

3 kg of these granules were added to the container, 100 mm in diameter, of an 800 tons Loewy extrusion press, the container previously having been preheated and maintained at 450° C. The die was selected to obtain a flat bar of size 40 ×5 mm. The extrusion ratio was thus 40. The maximum pressure was 280 bars and the velocity of the ram was 2.2 mm/second, corresponding to an outlet velocity of the shaped section of 5.2 m/minute. The shaped section left the press at a temperature of about 410° C. and was allowed to cool spontaneously in an undisturbed atmosphere.

The mechanical and electrical properties of the crude, drawn flat section were measured, and the results are as follows:

R = 17 hb
$LE_{0.2}$ = 12.1 hb
A = 35.2% (on 5.65 $\sqrt{s}$) "s" being the calibrated cross section of the test-piece
$\rho$ = 2.95 μΩ cm In order to evaluate the thermal stability of the extruded flat sections, annealing was then carried out at increasing temperatures by adding the said flat sections to the hot furnace and removing them to an undisturbed atmosphere after the specified time. The mechanical and electrical characteristics were remeasured:

| Length and temperature of annealing | $R_{hb}$ | $LE_{0.2}$hb | A % on 5.65 $\sqrt{s}$ | $\rho$ μ Ω cm |
|---|---|---|---|---|
| 3 hrs at 220° C | 17.2 | 12 | 31.9 | 2.95 |
| 3 hrs at 240° C | 17.3 | 12.5 | 34.3 | 2.95 |
| 3 hrs at 260° C | 17.1 | 12 | 37.8 | 2.95 |
| 3 hrs at 280° C | 17 | 12.4 | 35.1 | 2.95 |
| 3 hrs at 350° C | 17.2 | 11.9 | 32.9 | 2.95 |
| 3 hrs at 500° C | 14.3 | 9.2 | 36.6 | — |

It is found that softening by recrystallization is exhibited only above 350° C.

Finally, the cold bending ability of the flat sections as extruded is evaluated.

Tests were carried out at angles of 90° and 180°, and with radii equal to, respectively, 2*e*, 1.75*e*, 1.5*e*, and 1.25*e*, "e" being the thickness of the flat sections, i.e. 5mm. These tests showed that the sections have a remarkable bending ability without any cracks or sagging occurring.

Micrographic examination showed a structure very highly fibered in the extrusion direction, the structure being of the non-recrystallized, recovered type, and a very uniform distribution of fine particles consisting of monoclinic $Al_3Fe$.

EXAMPLE 2

Under the same conditions as in Example 1, Al-Fe granules were manufactured containing 0.77% of Fe and having the following composition:

Fe:0.77%
Si:0.05%
Cu:<0.03%
Mn:<0.003%
Ti:<0.003%
V:<0.002%
Cr:<0.002%
B:0.010%
Mg:<0.001%

Drawing was carried out under the same conditions as in Example 1, but the container of the press was heated to only 350° C.

The 40 × 5 flat sections thus obtained had the following characteristics:

R = 14hb
$LE_{0.2}$ = 11.7 hb
A = 35.5% (on 5.65 $\sqrt{s}$)
$\rho$ = 2.85 $\mu\Omega$ cm
bending at 90°, $r$ = 1.25 × $e$ (6.25 mm): excellent. No cracks
bending at 180°, face to face ($r$ < 0.5$e$): excellent. No cracks

EXAMPLE 3

Starting with the Al-Fe granules containing 0.77% Fe used in Example 2, 40 × 5 mm flat plates were extruded under the conditions of Example 2, modified in the following manner:

temperature of the container — 450° C.
velocity of the ram — 8.8 mm/sec (instead of 2.2 in Example 2)
outlet velocity — 21 m/minute (instead of 5.2 in Example 2)

The flat sections have the following characteristics:

R = 13.7 hbar
$LE_{0.2}$ = 11.5 hbar
A = 40% (on 5.65 $\sqrt{s}$)
$\rho$ = 2.85 $\mu\Omega$ cm
bending at 90°, $r$ = 1.25 × $e$ (6.25 mm): excellent. No cracks

EXAMPLE 4

Under the same conditions as in Example 1, Al-Fe granules containing 1.30% of Fe were manufactured, with or without the addition of 0.03% by weight of beryllium, the chemical composition otherwise being as follows:

Si 0.09%
Cu<0.01%
Ni<0.01%
Mn<0.01%
Ti<0.01%
V<0.01%
Cr<0.01%
Mg<0.01%

The extrusion was carried out under the same conditions as in Example 1 (800 tons press, container $\phi$ 100 mm, preheated and kept at 450° C., 3 kg of granules introduced cold into the container, 40 × 5 mm die but with a ram velocity of 6.5 mm/second, corresponding to an outlet velocity of the shaped section of 16 m/minute (rate of compression up to 250 bars: 2.2 mm/second = ram velocity).

The temperature of the shaped section at the outlet of the drawplate was also about 400° C. Cooling was in an undisturbed atmosphere. The mechanical and electrical characteristics measured at the start and at the end of drawing for the drawn flat sections of Al-Fe 1.30%, with and without beryllium, are as follows:

| Alloy | Position | R hbar | $R_{0.2}$ hbar | A % on 5.65 $\sqrt{s}$ | $\rho$ $\mu\Omega$ cm | bending at 90° r=1.25 e |
|---|---|---|---|---|---|---|
| without Be | at start of drawing | 14.3 | 9.8 | 36.3 | 2.883 | excellent |
| | at end of drawing | 13.8 | 9.4 | 31.2 | 2.870 | excellent |
| with Be | at start of drawing | 15.2 | 11.6 | 33.6 | 2.886 | excellent |
| | at end of drawing | 14.5 | 10.3 | 35.7 | 2.886 | excellent |

EXAMPLE 5

Under the same conditions as in Examples 1 and 2, Al-Fe granules containing 0.77% of Fe were manufactured and drawn in the form of a machine wire 9.5 mm in diameter, the container was preheated to 450° C. Extrusion in several presses was performed, in accordance with the technique of continuous extrusion with a die having an entrance cavity. The machine wire bar was then drawn to a diameter of 2 mm on a single pass machine without any intermediate annealing. The characteristics of the crude drawn wire, annealed for 3 hours at 220°, 250° and 300° C. respectively, were measured, and the results are as follows:

| State | $R_{hb}$ | $LE_{0.2hb}$ | A % on 200 mm | $\rho$ $\mu\Omega$ cm |
|---|---|---|---|---|
| as extruded | 21.7 | 20.1 | 5.4 | 2.856 |
| 3 hrs. at 220° C | 19.4 | 17.8 | 3.4 | 2.828 |
| 3 hrs. at 250° C | 17.8 | 16.4 | 6.4 | 2.823 |
| 3 hrs. at 300° C | 16.2 | 14.7 | 11.0 | 2.796 |

EXAMPLE 6

Starting from Al-Fe granules containing 2.9% of Fe and obtained in accordance with Example 1, flat sections 40 × 10 mm and 50 × 15 mm in size are extruded in such a way as to influence the drawing ratio (which is 40 for 40 × 5 mm flat sections obtained in a Loewy press with a 100 mm diameter container). The following results are obtained:

| Size in mm | Extrusion ratio | $R_{hb}$ | $LE_{0.2hb}$ | A % on 5.65 Vs | $\rho$ $\mu\Omega$ cm | bending at 90°, R 1.25 |
|---|---|---|---|---|---|---|
| 40 × 5 (Ex. 1) | 40 | 17 | 12.1 | 35.2 | 2.93 | excellent |
| 40 × 10 | 20 | 17 | (11.5) | 30.5 | 2.96 | excellent |
| 50 × 15 | 10 | 17 | 11 | 36 | 2.94 | excellent |

It is found that under drawing conditions which are otherwise identical, the influence of the extrusion ratio, which is between 10 and 40, has little effect on the characteristics of the drawn products.

EXAMPLE 7

Al-Fe flat sections manufactured according to Example 1 are cold rolled to a thickness of 1.5 mm, and the characteristics of the strip obtained are measured in the cold-drawn state (crude rolled product) and after various softening annealing treatments, the results obtained are as follows:

| State | $R_{hb}$ | $LE_{0.2hb}$ | A % on 5.65 $\sqrt{S}$ | $\rho$ $\mu\ \Omega$ cm |
|---|---|---|---|---|
| Crude rolled product (cold worked) | 24.6 | 21.8 | 10.5 | 3.03 |
| Annealing: | | | | |
| 3 hrs. at 240° C | 22 | 18.9 | 15 | 3.01 |
| 3 hrs. at 280° C | 20.8 | 17.7 | 20 | 2.99 |
| 3 hrs. at 250° C | 14.3 | 6.8 | 35 | 2.94 |

It is found that the cold working treatment noticeably raises the value of R and LE without producing any unacceptable drop in A. Different interesting intermediate states may be obtained by annealing, in accordance with the intended application.

I claim:

1. A process for forming electrical conductors of aluminum-iron alloy consisting of by weight from 0.5 to 5% of iron, from 0.02 to 0.2% of silicon, the remainder being aluminum and impurities, comprising granulating the Al-Fe alloy into particles of an acicular shape having a diameter of between about 50 and 1000 $\mu$m and a length of between about 1 and 10 mm, introducing said shaped divided alloy into a container of an extrusion press, preheating said container at a temperature between about 300° and 600° C., and extruding said alloy at a press extrusion ratio at least equal to about 5 to about 10 to provide conductors having a very highly fibered structure in the longitudinal direction and in which are present monoclinic $Al_3$ Fe particles.

2. A process as defined in claim 1 wherein the container is preheated preferably between 350° and 500° C.

3. A process as defined in claim 1 wherein the granulated Al-Fe alloy in the container is subjected to precompression before extrusion.

4. A process for forming electrical conductors of aluminum-iron alloy consisting of by weight from 0.5 to 5% of iron, from 0.02 to 0.2% of silicon, the remainder being aluminum and impurities, comprising granulating the Al-Fe alloy into particles of an acicular shape having a diameter of between about 50 and 1000 $\mu$m and a length of between about 1 and 10 mm, comprising compacting said granular alloy in the form of billets by cold compression, introducing said billets into a container of an extrusion press at a temperature below 350° C., and extruding said alloy at a press extrusion ratio at least equal to about 5 to about 10 provide conductors having a very highly fibered structure in the longitudinal direction and in which are present monoclinic $Al_3Fe$ particles.

5. A process as defined in claim 4 wherein said cold compression is performed in a vacuum.

6. A process as defined in claim 1 wherein the extruded product is subsequently deformed or shaped cold and then heat treated.

* * * * *